United States Patent [19]

Miller

[11] Patent Number: 4,790,890

[45] Date of Patent: Dec. 13, 1988

[54] PACKAGED EMULSION EXPLOSIVES AND METHODS OF MANUFACTURE THEREOF

[75] Inventor: Kenneth A. Miller, West Jordan, Utah

[73] Assignee: IRECO Incorporated, Salt Lake City, Utah

[21] Appl. No.: 128,097

[22] Filed: Dec. 3, 1987

[51] Int. Cl.[4] ..... C06B 45/00

[52] U.S. Cl. ..... 199/2; 149/109.6; 102/282; 102/324

[58] Field of Search ..... 102/324, 282; 149/109.6, 2

[56] References Cited

U.S. PATENT DOCUMENTS

| | | | |
|---|---|---|---|
| 3,691,954 | 9/1972 | Kern | 102/324 |
| 4,102,240 | 7/1978 | Cook et al. | 149/109.6 |
| 4,138,281 | 2/1979 | Olney et al. | 149/2 |
| 4,161,142 | 7/1979 | Edwards et al. | 149/46 |
| 4,195,548 | 4/1980 | Cook et al. | 149/109.6 |
| 4,525,225 | 6/1985 | Cechanski | 149/2 |
| 4,676,849 | 6/1987 | Curtin | 149/2 |

*Primary Examiner*—Stephen J. Lechert, Jr.

[57] ABSTRACT

The present invention relates to packaged explosives and methods of manufacture thereof and more particularly to packaged emulsion explosives. The term "emulsion" as hereafter used shall mean an oil-continuous emulsion having a continuous organic fuel phase and a discontinuous oxidizer solution phase dispersed as fine droplets throughout the fuel phase. The term "explosive" shall mean a detonable composition which can be either cap-sensitive or noncap-sensitive, as desired. The term "packaged" shall refer to cylindrical tubes or sticks of emulsion explosive of any desired length and having a diameter of generally four (4) inches or less, although larger diameter products also can be made by the methods described herein.

18 Claims, No Drawings

PACKAGED EMULSION EXPLOSIVES AND METHODS OF MANUFACTURE THEREOF

BACKGROUND OF THE INVENTION

Emulsion explosives are well-known in the art. See, for example, U.S. Pat. Nos. 4,356,044; 4,322,258; 4,141,767; 3,447,978 and 3,161,551. Emulsion explosives are found to have certain advantages over oonventional aqueous slurry explosives, which have a continuous aqueous phase, as described in U.S. Pat. No. 4,141,767.

Emulsion explosives generally are formed at elevated temperatures, which are necessary to form the solution of oxidizer salt(s) in water. It has been found, however, that once the emulsion explosive is formed at the elevated temperature, it should be cooled rapidly to ambient temperature in order to preserve its long-term storage stability. Moreover, where such emulsion explosives are chemically gassed for sensitivity purposes, the formulated emulsion should be cooled quickly to minimize migration and coalescence or escape of the chemically generated gas bubbles within the emulsion. Accordingly, in forming chemically gassed, packaged emulsion explosives, it is desirable to cool each stick package as quickly as possible.

Packaged explosives have been manufactured for many years. For example, dynamites have been paper-wrapped in conventional machines to form symmetrical cylindrical sticks having crimped or "squared" ends that form planer surfaces perpendicular to the axis of the cylindrical stick. Packages in this form are convenient for handling, and when loaded into boreholes, have good end-to-end contact which facilitates stick-to-stick propagation of a detonation. Slurry explosives, which comprise a thickened gel of oxidizer salt solution throughout which a fuel is dispersed or dissolved, have been packaged in a sausage-like form in a flexible tubing such as polyethylene having clipped ends. A process and apparatus for packaging slurry explosives in a sausage-like form is described in U.S. Pat. No. 3,783,735. The clipped ends, however, tend to interfere with close end-to-end contact, and thus clipped polyethylene tubes are not as desirable as crimped paper tubes in assuring reliable detonation propagation from stick to stick in a loaded borehole. More recently, emulsion explosives have been packaged either in crimped paper tubes, similar to that used for packaging dynamite, or in sausage-like clipped tubes, similar to that used for packaging slurry explosives. For certain applications and for the reasons set forth above, it is desirable to package emulsion explosives in symmetrical paper-wrapped cylinders having squared ends formed by crimping or other means.

Emulsion explosives generally require some form of uniform distribution of gas bubbles for adequate detonation sensitivity. A common method of introducing sensitizing gas bubbles is incorporating a uniform distribution of void containing materials, such as glass or plastic microspheres or perlite, throughout the emulsion. These void containing materials will not tend to migrate or coalesce once dispersed throughout the emulsion, and therefore, packaging of emulsions containing these materials is relatively simple.

Another means of sensitizing emulsion explosives is by the introduction of ingredients which react chemically to produce gas bubbles. Chemical gassing is a less expensive means of sensitization than the use of hollow microspheres and is therefore preferred from a cost standpoint. These free, discrete gas bubbles tend to migrate and/or coalesce in the emulsion or escape from the emulsion, however, unless inhibited by the viscosity of the emulsion itself. Because emulsions are relatively fluid at their elevated formulation temperatures, it is important to cool them quickly and render them sufficiently viscous to minimize migration of the gas bubbles. Heretofore, chemically gassed emulsion explosives have been manufactured in sausage-like packages that are filled and cooled quickly to prevent gas migration. Paper wrapping has not been possible, since it requires that the emulsion be handled while still hot, thereby allowing for migration or escape of gas bubbles.

An additional problem with chemically gassed emulsions is that they tend to shrink in volume as they cool from their elevated formulation temperatures. This is because the volume of an individual gas bubble decreases as the temperature decreases. Thus if chemically gassed emulsions are paper wrapped at their elevated formulation temperatures, undesirable shrinkage within the paper package would occur upon cooling. In accordance with the present invention, however, if chemically gassed emulsions are prepackaged in a flexible tubing, preferably under pressure, and cooled prior to paper wrapping, shrinkage within the paper wrapped cartridge essentially is eliminated. A need therefore exists for a method of manufacturing chemically gassed emulsions in symmetrical cylindrical packages, such as paper-wrapped packages having crimped ends.

SUMMARY OF THE INVENTION

The present invention provides a means by which emulsion explosives can be packaged in symmetrical cylinders, such as paper packages having crimped ends. This is accomplished with minimal migration and coalesence of chemically produced gas bubbles and consequent loss of detonation sensitivity. Product shrinkage within the package also is minimized since the gas bubbles are maintained under pressure while cooling and therefore do not contract. More specifically, the methods of the present invention provide for cooling of the chemically gassed emulsion prior to final packaging. After formation, the emulsion explosive preferably is prepackaged into a flexible tubing which then is cooled prior to overwrapping with an additional packaging material. This prepackaging method protects the product if cooled in a water bath, establishes the desired cylindrical geometry, and promotes retention of the gas bubbles. The inner sleeve of flexible tubing also provides an additional layer of protective or moisture-resistant packaging. The prepackaging material either can be removed prior to the final packaging or simply can be overwrapped. The flexible tubing can be continuous until cooled and then cut into desired lengths for overwrapping.

In addition to working with chemically gassed emulsion explosives, the methods of the invention also allow for packaging of emulsion explosives that are gassified by entrainment of gas bubbles during mixing of the emulsion or by dissolving a gas under pressure in either the oxidizer solution or fuel phase of the emulsion, which dissolved gas then effervesces upon return to ambient pressure. Although the methods of the invention are particularly advantageous for packaging emulsion explosives sensitized by gas bubbles, such methods can also be used to package emulsion explosives sensitized by void containing materials.

DETAILED DESCRIPTION OF THE INVENTION

The compositions of the packaged emulsion explosives comprise an immiscible organic fuel forming the continuous phase of the composition in an amount generally from about 3% to about 12% by weight of the composition; emulsifier; inorganic oxidizer salt solution (or melt) forming the discontinuous phase of the composition, generally comprising inorganic oxidizer salt in an amount from about 45% to about 95%; and water and/or water-miscible organic liquids preferably in an amount of from about 2% to about 15%. The "water-in-oil" emulsifier is employed generally in an amount of from about 0.1% to about 5% by weight. Preferred organic fuels are mineral oil, No. 2 fuel oil, paraffin waxes, microcrystalline waxes and mixtures thereof. The oxidizer salts are selected from the group consisting of ammonium, alkali and alkaline earth metal nitrates, chlorates and perchlorates. Ammonium nitrate is usually the predominant oxidizer salt, and lesser amounts of sodium nitrate or calcium nitrate are commonly used. A portion of the total oxidizer salt may be added in particle or prill form.

The packaged explosives are reduced from their natural densities by addition of a density reducing agent(s) in an amount sufficient to reduce the density to within the range of from about 0.9 to about 1.4 g/cc. Although glass or plastic microspheres or perlite can be used as the density reducing agent or part thereof, the methods of the present invention are particularly advantageous with respect to density reduction by means of chemical gassing, entrainment or pressurized dissolution, as previously described.

The flexible prepackaging material or underwrapping is preferably a plastic film such as polyethylene. It can be handled conventionally in an extrusion process such as that described in U.S. Pat. No. 3,783,735. Preferably the emulsion is extruded and prepackaged in a continuous length that then is cooled, for example, by submersion in a water bath, prior to cutting into individual sticks for overwrapping with the final packaging material. The prepackaged emulsion can be cooled by water, air or refrigeration in conventional means. The preferred cooling means is a water bath, which is much more time efficient than air cooling. The cooled, individual sticks then are overwrapped by a conventional means. The overwrapping material preferably is selected from the group consisting of paper, waxed paper, plastic film and heat shrinkable plastic film. Conventional packaging means include heat shrinkable film packages, paper overwrap machines such as labelers and explosives packaging machines such as a Rollex machine that is well-known in the art. The actual apparatus employed is not critical and can be readily selected or designed by those skilled in the art.

The emulsion explosives may be formulated in a conventional manner. Typically, the oxidizer salt(s) first is dissolved in the water (or aqueous solution of water and miscible liquid fuel) at an elevated temperature of from about 25° C. to about 105° C., depending upon the crystallization temperature of the salt solution. The aqueous solution then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. Solid ingredients, if any, then are added and stirred throughout the formulation by conventional means. The formulation process also can be accomplished in a continuous manner as is known in the art.

Reference to the following examples further illustrates the invention.

An emulsion with the following composition is made:

| | |
|---|---|
| AN | 69.33 |
| CN | 13.17 |
| $H_2O$ | 11.49 |
| Emulsifier | 1.45 |
| Mineral Oil | 0.26 |
| Wax | 4.00 |
| Thiourea | 0.10 |
| Nitrite Gassing Agent | 0.20 |

The emulsion is packaged in 1½ inch continuous polyethylene-polyester-polyethylene tri-laminate film at a temperature of 90° C.

The continuous emulsion charge is placed on a cooling belt and immersed in 5° C. water. After cooling for twenty minutes the core temperature of the charge is reduced to about 16° C. and the product is in a semi-solid state. The continuous charge then is cut into 16-inch lengths and paper overwrapped on a Model 20C Labelette paper overwrapping machine. The exposed ends are closed by crimping with a star crimp, a standard technique for closing dynamite charges.

A second emulsion is made, having the following composition:

| | |
|---|---|
| AN | 72.20 |
| SN | 10.90 |
| $H_2O$ | 7.50 |
| Emulsifier | 0.80 |
| Mineral Oil | 0.50 |
| Wax | 2.80 |
| Aluminum | 5.00 |
| Thiourea | 0.10 |
| Nitrite Gassing agent | 0.20 |

The emulsion is packaged in 1½ inch diameter continuous Valeron plastic packaging film at a temperature of 96° C. Cooling is accomplished under water as in the first example, with the final core temperature being about 23° C. after thirty minutes in 5° C. water. Overwrapping and end closure are accomplished by inserting each charge into a heat shrinkable plastic tube, larger in diameter and longer than the charge and shrinking said tube until it seals tightly around the charge. An automated machine capable of providing this covering is the Weldotron model 1600 from Weldotron Corporation, Piscataway, N.J.

The packaged emulsion explosives of the present invention can be used conventionally, and thus they can be used in most applications where other packaged products, such as dynamites, are used.

While the present invention has been described with reference to certain illustrative examples and preferred embodiments, various modifications will be apparent to those skilled in the art and any such modifications are intended to be within the scope of the invention as set forth in the appended claims.

What is claimed is:

1. A method of manufacturing emulsion explosives comprising (a) forming an oil-continuous emulsion at an elevated temperature, (b) incorporating a density reducing agent into the emulsion to sensitize it, (c) packaging the sensitized emulsion into a flexible tubing of desired diameter, (d) cooling the loaded tubing to a desired temperature, and (e) overwrapping the loaded tubing with an additional packaging material.

2. A method of manufacturing emulsion explosives comprising (a) forming an oil-continuous emulsion at an elevated temperature, (b) incorporating a sensitizing, uniform distribution of gas bubbles into the emulsion to form an emulsion explosive, (c) packaging the emulsion explosive into a continuous flexible tubing of desired diameter, (d) cooling the loaded continuous tubing to a desired temperature, (e) cutting the loaded continuous tubing into individual tubes of desired lengths, and (f) overwrapping the individual tubes with an additional packaging material.

3. A method according to claim 1 wherein the oil-continuous emulsion comprises droplets of oxidizer solution or melt dispersed within a continuous fuel phase and the emulsion is formed at a temperature above the solidification temperature of the oxidizer solution.

4. A method according to claim 3 wherein the continuous fuel phase is selected from the group consisting of mineral oil, No. 2 fuel oil, vegetable oils, paraffin waxes, microcrystalline waxes and mixtures thereof.

5. A method according to claim 1 wherein the density reducing agent is a void containing material.

6. A method according to claim 1 wherein the density reducing agent is a uniform distribution of gas bubbles.

7. A method according to claims 2 or 6 wherein the gas bubbles are incorporated by means of a gassing agent that chemically decomposes in the emulsion to produce gas bubbles.

8. A method according to claims 2 or 6 wherein the gas bubbles are incorporated by entrainment during mixing of the emulsion.

9. A method according to claims 2 or 6 wherein the gas bubbles are incorporated by dissolving the gas under pressure in either the oxidizer solution or fuel phase, which dissolved gas then effervesces upon return to ambient pressure.

10. A method according to claim 1 wherein the emulsion explosive is continuously extruded in cylindrical form into tubing material that then is formed around the extruded explosive and sealed to form the continuous flexible tubing.

11. A method according to claim 1 wherein the overwrapping packaging material is selected from the group consisting of paper, waxed paper, plastic film and heat shrinkable plastic film.

12. A method according to claim 1 wherein the cooling is accomplished by passing the loaded continuous tubing through a cooling water bath.

13. A method of manufacturing emulsion explosives comprising (a) forming an oil-continuous emulsion at an elevated temperature, (b) incorporating a density reducing agent into the emulsion to form an emulsion explosive, (c) packaging the emulsion explosive into a flexible tubing of desired diameter, (d) cooling the loaded tubing to a desired temperature, (e) removing the tubing from the cooled emulsion explosive, and (f) wrapping the cooled emulsion explosive with a packaging material.

14. A method according to claim 13 wherein the flexible tubing is continuous and after cooling is cut into individual lengths of emulsion explosive which then are individually wrapped with a packaging material after removal of the tubing.

15. A method according to claim 13 wherein the density reducing agent is a void containing material selected from the group consisting of glass or plastic microspheres and perlite.

16. A method according to claim 13 wherein the density reducing agent is a sensitizing, uniform distribution of gas bubbles.

17. A packaged emulsion explosive sensitized by air bubbles wherein the packaging material comprises a cylindrical flexible tube underwrapping and a paper or plastic material overwrapping.

18. A packaged emulsion explosive according to claim 17 wherein the underwrapping is a plastic film and the overwrapping is selected from the group consisting of paper, waxed paper, plastic film or heat shrinkable plastic film.

* * * * *